US009540893B2

(12) United States Patent
Freyer

(10) Patent No.: US 9,540,893 B2
(45) Date of Patent: Jan. 10, 2017

(54) CABLE DUCT DEVICE IN A SWELLING PACKER

(71) Applicant: HALLIBURTON ENERGY SERVICES, INC., Carrollton, TX (US)

(72) Inventor: Rune Freyer, Stavanger (NO)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 14/309,143

(22) Filed: Jun. 19, 2014

(65) Prior Publication Data

US 2014/0305661 A1 Oct. 16, 2014

Related U.S. Application Data

(63) Continuation of application No. 12/624,282, filed on Nov. 23, 2009, which is a continuation of application No. 10/538,330, filed as application No. PCT/NO03/00410 on Dec. 9, 2003, now abandoned.

(30) Foreign Application Priority Data

Dec. 10, 2002 (NO) ..... 20025911

(51) Int. Cl.

| | |
|---|---|
| ***E21B 33/12*** | (2006.01) |
| ***E21B 23/06*** | (2006.01) |
| ***E21B 17/00*** | (2006.01) |
| ***E21B 33/127*** | (2006.01) |

(52) U.S. Cl.

CPC ..... *E21B 23/06* (2013.01); *E21B 17/003* (2013.01); *E21B 33/12* (2013.01); *E21B 33/127* (2013.01)

(58) Field of Classification Search

CPC ..... E21B 33/12; E21B 33/1208

See application file for complete search history.

(56) References Cited

U.S. PATENT DOCUMENTS

| | | | |
|---|---|---|---|
| 1,736,254 | A | 1/1929 | Davis |
| 2,144,026 | A | 1/1939 | Park |
| 2,242,166 | A | 5/1941 | Bennett |
| 2,253,092 | A | 8/1941 | Pranger |
| 2,814,947 | A | 12/1957 | Stegemeier |
| 2,849,070 | A | 8/1958 | Maly |
| 2,945,541 | A | 7/1960 | Maly et al. |
| 3,385,367 | A | 5/1968 | Kollsman |
| 3,776,561 | A | 12/1973 | Haney |
| 3,899,631 | A | 8/1975 | Clark |
| 3,933,203 | A | 1/1976 | Evans |

(Continued)

FOREIGN PATENT DOCUMENTS

| | | | |
|---|---|---|---|
| CN | 1452686 | A | 10/2003 |
| EP | 1570151 | B1 | 7/2005 |

(Continued)

OTHER PUBLICATIONS

Office Action issued Nov. 3, 2014 for U.S. Appl. No. 12/624,282, 9 pages.

(Continued)

*Primary Examiner* — David Andrews
(74) *Attorney, Agent, or Firm* — Locke Lord LLP

(57) ABSTRACT

A cable duct device in a swellable packer, in which the swellable packer is provided with at least one opening therethrough which is adapted to constitute a duct for a cable.

7 Claims, 4 Drawing Sheets

IIa–IIa

(56) References Cited

U.S. PATENT DOCUMENTS

| | | | | |
|---|---|---|---|---|
| 4,042,023 | A | 8/1977 | Fox | |
| 4,137,970 | A | 2/1979 | Laflin et al. | |
| 4,202,087 | A | 5/1980 | Wilderman | |
| 4,234,197 | A | 11/1980 | Amancharla | |
| 4,375,240 | A | 3/1983 | Baugh et al. | |
| 4,444,403 | A | 4/1984 | Morris | |
| 4,633,950 | A | 1/1987 | Delhommer et al. | |
| 4,862,967 | A | 9/1989 | Harris | |
| 5,035,286 | A | 7/1991 | Fitzgibbon, Jr. | |
| 5,091,471 | A | 2/1992 | Graves et al. | |
| 5,195,583 | A | 3/1993 | Toon et al. | |
| 5,217,071 | A | 6/1993 | Ferry et al. | |
| 5,327,962 | A | 7/1994 | Head | |
| 5,433,269 | A | 7/1995 | Hendrickson | |
| 5,876,042 | A | 3/1999 | Graf et al. | |
| 5,944,322 | A | 8/1999 | Coff et al. | |
| 6,009,951 | A | 1/2000 | Coronado et al. | |
| 6,135,210 | A | 10/2000 | Rivas | |
| 6,173,788 | B1 | 1/2001 | Lembcke et al. | |
| 6,318,729 | B1 | 11/2001 | Pitts, Jr. et al. | |
| 6,325,144 | B1 | 12/2001 | Turley et al. | |
| 6,354,372 | B1 | 3/2002 | Carisella et al. | |
| 6,367,845 | B1 | 4/2002 | Otten et al. | |
| 6,705,615 | B2 | 3/2004 | Milberger et al. | |
| 6,834,725 | B2 | 12/2004 | Whanger et al. | |
| 7,059,415 | B2 | 6/2006 | Bosma | |
| 7,143,832 | B2 | 12/2006 | Freyer | |
| 7,222,676 | B2 | 5/2007 | Patel et al. | |
| 7,690,437 | B2 | 4/2010 | Guillot et al. | |
| 7,849,930 | B2 | 12/2010 | Chalker et al. | |
| 2002/0092649 | A1 | 7/2002 | Bixenman et al. | |
| 2004/0007829 | A1 | 1/2004 | Ross | |
| 2004/0020662 | A1 | 2/2004 | Freyer | |
| 2004/0238168 | A1* | 12/2004 | Echols | 166/278 |
| 2005/0171248 | A1 | 8/2005 | Li et al. | |
| 2005/0199401 | A1 | 9/2005 | Patel et al. | |
| 2006/0272806 | A1 | 12/2006 | Wilkie et al. | |
| 2007/0012436 | A1 | 1/2007 | Freyer | |
| 2007/0151724 | A1 | 7/2007 | Ohmer et al. | |
| 2007/0205002 | A1 | 9/2007 | Baaijens et al. | |
| 2007/0257405 | A1 | 11/2007 | Freyer | |
| 2008/0308283 | A1 | 12/2008 | Freyer | |
| 2010/0065284 | A1 | 3/2010 | Freyer | |

FOREIGN PATENT DOCUMENTS

| | | | |
|---|---|---|---|
| GB | 2336170 | A | 10/1999 |
| GB | 2355740 | A | 5/2001 |
| RU | 2157440 | C2 | 10/2000 |
| WO | 0220941 | A1 | 3/2002 |
| WO | 02/059452 | A1 | 8/2002 |
| WO | 2005090741 | A1 | 9/2005 |
| WO | 20050116394 | A1 | 12/2005 |
| WO | 2006118470 | A1 | 11/2006 |

OTHER PUBLICATIONS

Norwegian Examination and Search Report issued Jun. 6, 2003, for NO application serial No. 2002 5911, 3 pages.
European Examination Report issued Feb. 15, 2006, for EP application serial No. 03813035.7-2315, 3 pages.
Australian Examination Report issued Aug. 23, 2006, for AU application serial No. 2003303119, 2 pages.
International Search Report and Written Opinion issued Mar. 21, 2008, for International Patent Application Serial No. PCT/US07/61703, 6 pages.
European Notice of Opposition issued Apr. 14, 2008, for EP Patent No. 1570151, 27 pages.
Response dated Nov. 21, 2008, to EPC Notice of Opposition for EP Patent No. 1570151 filed Apr. 14, 2008, by Swellfix B.V., 18 pages.
International Preliminary Report on Patentability issued Mar. 26, 2009, for International Patent Application Serial No. PCT/US07/35052, 5 pages.
Office Action issued Jun. 22, 2009, for U.S. Appl. No. 11/852,295, 16 pages.
International Preliminary Report on Patentability with Written Opinion issued Aug. 20, 2009, for International Patent Application Serial No. PCT/US07/61703, 7 pages.
Office Action issued Dec. 3, 2009, for U.S. Appl. No. 11/852,295, 10 pages.
Examiner's Answer issued Aug. 26, 2010, for U.S. Appl. No. 10/538,330, 10 pages.
International Search Report and Written Opinion issued Feb. 21, 2007 for International Patent Application No. PCT/US06/35052, 8 pages.
Office Action issued Mar. 16, 2011, for U.S. Appl. No. 12/016,600, 8 pages.
Office Action issued Jun. 30, 2011, for U.S. Appl. No. 12/016,600, 13 pages.
Chinese Office Action issued Jul. 6, 2011, for CN Patent Application No. 200680055799.8, 7 pages.
Brazilian Office Action Translation issued Oct. 17, 2011, for BR Patent Application No. PI0317127-2, 6 pages.
Office Action issued Jan. 31, 2012 for U.S. Appl. No. 12/016,600, 8 pages.
Office Action issued Apr. 9, 2012 for U.S. Appl. No. 13/303,477, 25 pages.
Office Action issued Jul. 3, 2012 for U.S. Appl. No. 12/016,600, 13 pages.
Office Action issued Sep. 10, 2012 for U.S. Appl. No. 13/303,477, 9 pages.
Office Action issued Nov. 6, 2012 for U.S. Appl. No. 12/016,600, 13 pages.
Russian Office Action issued Jan. 11, 2010, for Russian Patent Application Serial No. 2009113625, 2 pages.
English Translation of Russian Office Action issued Jan. 11, 2010, for Russian Patent Application Serial No. 2009113625, 2 pages.
Office Action issued Apr. 15, 2010 for U.S. Appl. No. 11/852,295, 7 pages.
Office Action issued Jun. 16, 2010 for U.S. Appl. No. 12/016,600, 47 pages.
Office Action issued Sep. 10, 2010 for U.S. Appl. No. 12/624,282, 15 pages.
Office Action issued Nov. 5, 2010 for U.S. Appl. No. 12/016,600, 10 pages.
Office Action issued Jan. 20, 2011 for U.S. Appl. No. 12/624,282, 15 pages.
Examiner's Answer issued Aug. 19, 2011 for U.S. Appl. No. 12/624,282, 16 pages.
Advisory Action issued Dec. 10, 2012 for U.S. Appl. No. 13/303,477, 23 pages.
Advisory Action issued Sep. 14, 2012 for U.S. Appl. No. 12/016,600, 7 pages.
Summons issued Feb. 1, 2013 for European Patent Application No. 03813035.7, 5 pages.
Examiner's Answer issued Apr. 25, 2013 for U.S. Appl. No. 13/303,477, 5 pages.
Tam International; "New FREECAP swellable elastomer packers swell on contact with well fluids for effective zonal isolation", company brochure, received Jul. 29, 2006, 1 page.
Tam International; "FREECAP Swellable Packers", webpage www.tamintl.com/pages/FREECAP/FreeCap1.html, dated 2000, retrieved Jul. 29, 2006, 1 page.
English Translation of Russian Office Action undated, for Russian Patent Application Serial No. 2009113625, 2 pages.
Russian Office Action issued Apr. 28, 2010, for Russian Patent Application Serial No. 2009113625, 4 pages.
Office Action issued Mar. 11, 2008 for U.S. Appl. No. 10/538,330, 9 pages.
Office Action issued Jun. 1, 2015 for U.S. Appl. No. 12/624,282, 14 pages.

* cited by examiner

I–I

II–II

IIa-IIa

CABLE DUCT DEVICE IN A SWELLING PACKER

CROSS-REFERENCE TO RELATED APPLICATIONS

The present application is a continuation of U.S. application Ser. No. 12/624,282 filed on Nov. 23, 2009, which is a continuation of U.S. application Ser. No. 10/538,330 filed on May 18, 2006, which is a national stage filing under 35 USC 371 of international application no. PCT/NO03/000410, filed Dec. 9, 2003, which claims priority to Norway application serial no. 20025911, filed Dec. 10, 2002. The entire disclosures of these prior applications are incorporated herein by this reference.

This invention relates to a cable duct in a swelling packer. More exactly it concerns a cable duct in a swelling packer adapted to seal an annulus between a production tubing and a casing, for example, or between a production tubing and the well formation in a well.

During the completion of a well, in particular a petroleum well, by which the well is prepared for production, a cable is usually arranged in the well parallel to production tubing. The cable is protectively arranged on the outside of the production tubing.

In this context a cable is intended to be any kind of cable or pipe, for example comprising electric lines, optical fibres, pipe lines for pressurized fluids or injection fluids, or combinations thereof. The cable may be adapted to conduct signals, supply of energy and chemicals between the surface and the well.

The term production tubing is used to illustrate the pipe enclosed by the packer. However, the packer is suitable to seal around any longitudinal body as well.

Due to technical conditions of the formation it may be necessary to provide one or more packers along the production tubing in its longitudinal extension to be able of sectioning the annulus encircling the production tubing.

According to the prior art, inflatable or mechanical expandable packers are used for this purpose. A mechanical expandable packer comprises a flexible material expanding against the casing or the walls of the formation when compressed in the axial direction of the well.

NO 20004509 discloses a swellable packer swelling in volume by the influence from the hydrocarbons of the well, whereby it is sealing against the casing or the walls of the formation.

According to prior art, it has been common to provide the packers with a cable extending through the packer and in which the cable at its end portions on the opposite sides of the packer is provided with connectors for the connection of the cable extending along the production tubing. It is obvious that the connectors of this kind may involve malfunctions, for example in the form of leakage of the pressurized fluids, bad electric contact or penetration of the formation fluids into the connectors. Thus, it is desirable to arrange whole lengths of the cable along the production tubing without having to join the cable at each packer.

U.S. Pat. No. 6,173,788 discloses a mechanical compressible packer provided with an outer longitudinal slot in which a cable may be arranged. When the packer is compressed and squeezed against the casing, the packer material is brought to squeeze sealingly around the cable. By being situated outside of the packer the cable is relatively poorly protected during the insertion of the production tubing into the well. Obviously, the cable is also subjected to relatively great loads during the mechanical compression. The use of mechanical compressible packers has proved to be unsuitable during the sealing against a well formation as the relative expansion of the packers are insufficient.

The object of the invention is to remedy the disadvantages of the prior art.

According to the invention the object is obtained by means of the features indicated in the description below and the accompanying patent claims.

A packer enclosing a production tubing and being formed from a swellable material is provided with a longitudinal opening therethrough. The opening is adapted to constitute a cable duct. Advantageously, the through-going opening is arranged relatively close to the tubing surface outside of the production tubing. The cross section of the through-going opening may exhibit any geometrical form such as circular or oval. In its longitudinal extension the opening may be straight or have another configuration, for example S-formed or helical.

If desirable the packer may be provided with a slit protruding from the outer circumference of the packer and into the through-going opening to facilitate placing of the cable in the through-going opening during the assembling work.

When the cable shall be arranged along the production tubing, it is unnecessary to join the cable at the packers. Thus, the cable extends protected in a manner known per se along the production tubing and continues in a protected manner within the through-going opening in the packer to the opposite end portion of the packer, from where it again extends protected along the production tubing.

After the production tubing is displaced into the well and the swellable material has obtained contact with the swell-activating material, the volume of the packer increases, whereby the packer expands and sealingly encloses the cable and seals against casing or the formation of the well.

A non-limiting example of a preferred embodiment is described hereinafter which is illustrated in the accompanying drawing, wherein.

Figure 1:
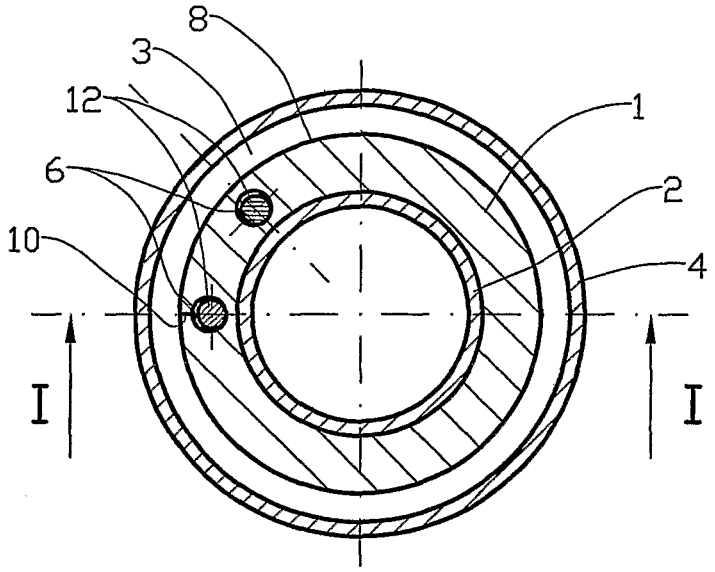
FIG. 1 shows in section a packer having two cables arranged therein during insertion into a casing.
Figure 2:
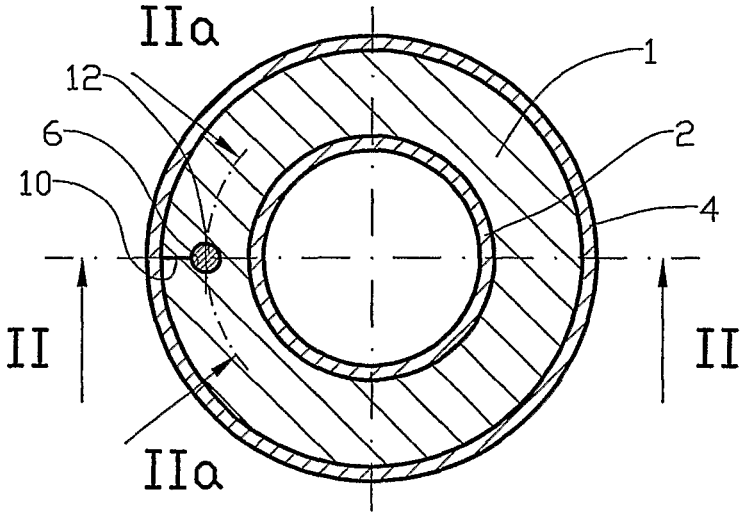
FIG. 2 shows a packer having one cable arranged therein after the material of the packer has swollen sufficiently so as the packer seals around the cable and against the casing.

In the drawings the reference numeral 1 denotes a packer manufactured from a swellable material, see below. The packer 1 encircles a production tubing 2 and is adapted to be able of sealing an annulus 3 between the production tubing 2 and the shell surface inside of a casing 4.

In its longitudinal extension the packer 1 is provided with an opening therethrough which is preferentially arranged relatively close to the shell surface outside of the production tubing 2.

Between the cylindrical surface 8 outside of the packer 1 and the through-going opening 6 there is provided a slit 10.

A cable 12 extends through the through-going opening 6.

Figure 3:
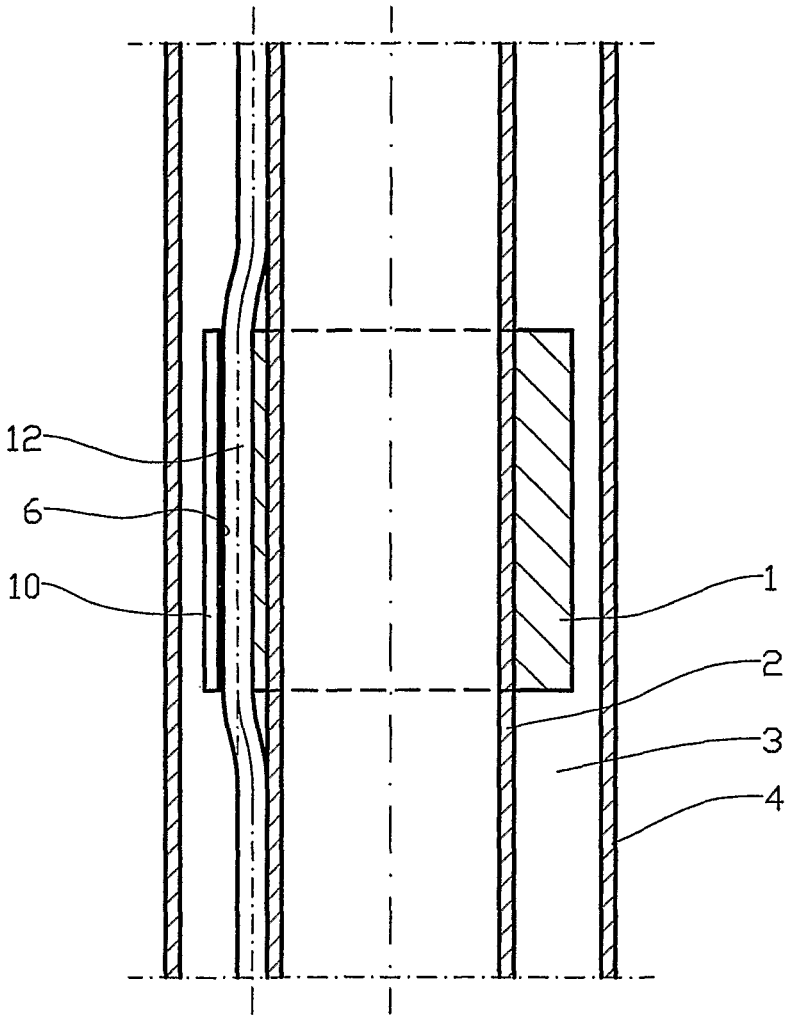
FIG. 3 shows a section view along I-I in FIG. 1.
Figure 4:
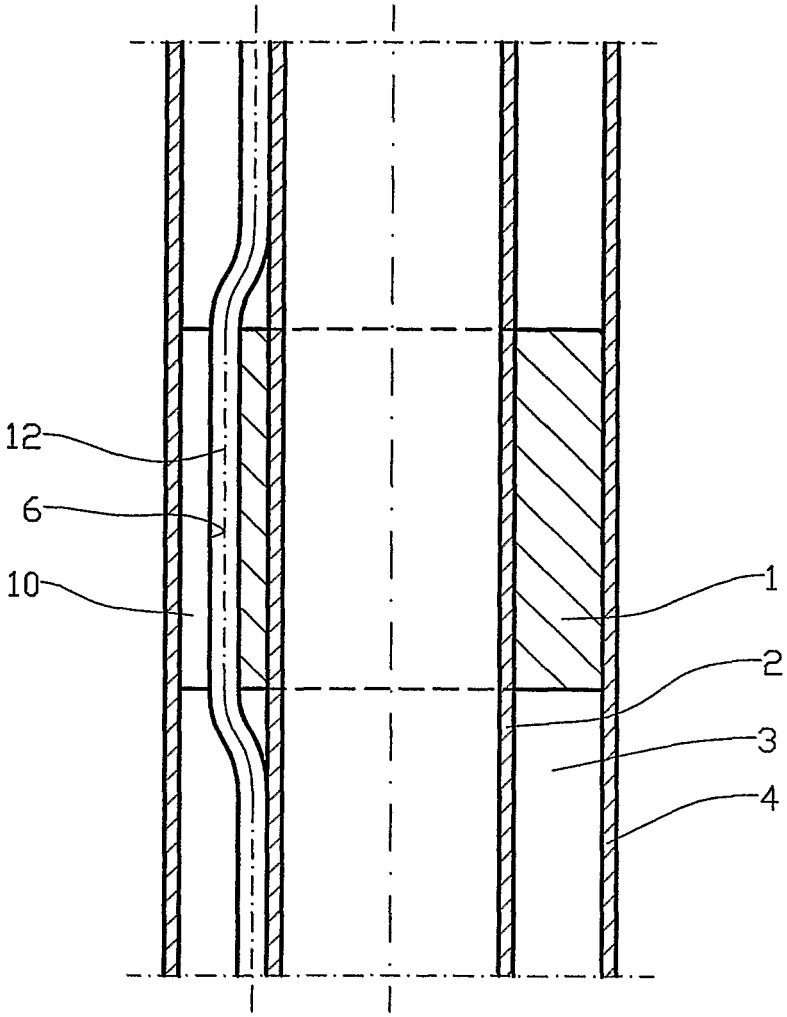
FIG. 4 shows a section view along II-II in FIG. 2.

When the cable 12 shall be arranged along the production tubing 2, see FIG. 3, the cable 12 extends along the shell outside of the production tubing 2, in which it is covered by a protection (not showed) according to prior art.

At the packer 1 the cable 12 extends into the through-going opening 6, in which the material of the packer 1 protects it. As the through-going opening 6 is situated close to production tubing 2, the cable 12 is relatively well protected also at the inlet and outlet of the through-going opening 6.

When the production tubing 2 along with packer 1 and cable 12 are situated in the well, the packer swells and seals the annulus 3 by contacting a swell-activating material which may be of water or hydrocarbons, for example, depending on the material from which the plug is formed.

By swelling in hydrocarbons the packer 1 may be manufactured from a rubber or rubber-like material selected from the group comprising EPDM, styrene-butadiene rubber, natural rubber, ethylene-propylene monomer rubber, ethylene-vinyl acetate rubber, hydrogenated acrylonitrile-butadiene rubber, acrylonitrile-butadiene rubber, isoprene rubber, chloroprene rubber and polynorbornene.

When water shall be the swell-material, the packer 1 may be formed according to U.S. Pat. No. 4,137,970 disclosing a swellable material casting in which the material manufactured from hydrogen dichromat being dissolved in water is mixed into a compound of glycerol and diethylene glycol. This compound is added a portion of polyacrylamide and then filled into a mould.

If desirable, the swellable material may be enclosed by a web-like material.

In an alternative embodiment the slit 10 may be situated between the through-going opening 6 and the production tubing 2.

In a further embodiment the packer 1 may be formed without the slit 10.

The packer 1 may be constituted by two or more segments together encircling the production tubing 2.

Figure 5:
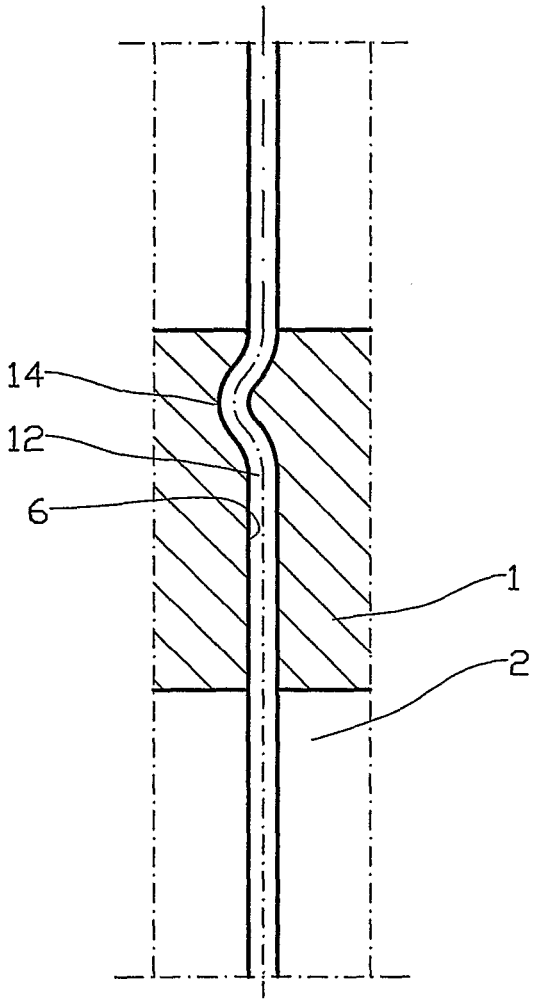
FIG. 5 shows a section view along IIa-IIa in FIG. 2.

In FIG. 5, an embodiment is shown in which the opening 6 in its longitudinal extension is formed with a bend 14. Due to the bend 14, a length of cable 12 inserted into the opening 6 is greater than a longitudinal length of the packer 1. The bend 14 provides for a reduced longitudinal stiffness of the cable 12.

If desirable, at least one cable 12 may be arranged on the inside of the packer (1) in a recess in the shell surface outside of the production tubing 2.

The invention claimed is:

1. A system comprising:

a production tubing having two packers disposed about an outer surface of the production tubing and arranged along a longitudinal extension of the production tubing;

each packer being formed of a swellable material and including a generally longitudinal through-going opening through the packer with a slit extending between the through-going opening and an outer surface of the packer prior to actuation of the packer, wherein each through-going opening includes a bend; and a cable extending along the longitudinal extension of the production tubing and through the through-going openings of the two packers, wherein a first length of the cable extending within the through-going openings is greater than a longitudinal length of the two packers.

2. The system of claim 1, wherein a second length of the cable between the two packers does not include ends connected with a connector.

3. The system of claim 1, wherein a portion of a second length of the cable between the two packers is protected.

4. The system of claim 1, wherein a portion of a second length of the cable between the two packers is arranged along the production tubing.

5. The system of claim 1, wherein the through-going opening of at least one of the two packers has a circular cross-section.

6. The system of claim 1, wherein the through-going opening of at least one of the two packers has an oval cross-section.

7. The system of claim 1, wherein at least one of the two packers is formed by two or more segments that together encircle the production tubing.

* * * * *